United States Patent [19]

Maruta et al.

[11] Patent Number: 4,810,853

[45] Date of Patent: Mar. 7, 1989

[54] GLOW PLUG FOR DIESEL ENGINES

[75] Inventors: Kenji Maruta; Hiroshi Suwabe, both of Kumagaya; Sachio Ogasawara, Niiborishinden; Mitusuke Masaka, Kawagoe; Koji Hatanaka, Kawajima, all of Japan

[73] Assignees: Hitachi Metals Ltd.; Jidosha Kiki Co Ltd., both of Japan

[21] Appl. No.: 109,465

[22] Filed: Oct. 15, 1987

[30] Foreign Application Priority Data

Oct. 28, 1986 [JP] Japan ..... 61-256354
Oct. 28, 1986 [JP] Japan ..... 61-256355
Feb. 16, 1987 [JP] Japan ..... 62-32643

[51] Int. Cl.[4] ..... F23Q 7/22
[52] U.S. Cl. ..... 219/270
[58] Field of Search ..... 219/270, 553, 267, 541; 123/145 A; 252/516, 518

[56] References Cited

U.S. PATENT DOCUMENTS 4,486,651 12/1984 Atsumi et al. ..... 219/553
4,661,686 4/1987 Yokoi et al. ..... 219/270

*Primary Examiner*—E. A. Goldberg
*Assistant Examiner*—M. M. Lateef
*Attorney, Agent, or Firm*—McGlew & Tuttle

[57] ABSTRACT

A glow plug for diesel engines includes a ceramic heater with a U-shaped heating portion and a pair of leads integrally formed with the heating portion and extending backwards from both ends of the heating portion. The heater is supported at one end thereof by a hollow holder in a cantilevered state with one end thereof protruding towards the outside. At least the outside surfaces of the leads are joined to, and held by, the inside of the holder via an insulating layer, and at least the rear ends of the other of the leads are connected via a metallic lead wire to an external connection terminal supported in an insulated state by the rear end of the holder. The ceramic heater is integrally formed from an electrically resistive sintered sialon produced by adding 20–70 vol. % Ti nitride or carbonitride as an electric conductivity donor to $\beta$-type sialon or a $\alpha/\beta$-type sialon.

11 Claims, 3 Drawing Sheets

GLOW PLUG FOR DIESEL ENGINES

BACKGROUND OF THE INVENTION

1. Field of the Invention

This invention relates generally to a glow plug to be used for preheating an auxiliary combustion chamber or combustion chamber in a diesel engine, and more particularly to a glow plug for diesel engines comprising a ceramic heater having an quick-heating function and self-saturation properties that permits after glowing for long hours.

2. Description of Prior Art

In general, a diesel engine has poor starting properties at low temperatures. To assist the diesel engine in starting, therefore, a glow plug is usually provided in an auxiliary combustion chamber or combustion chamber to raise the intake air temperature or use as an ignition source the heat generated by applying electricity to the plug. The glow plug is usually of a sheathed heater type constructed by filling a metallic sheath with heat-resistant insulating powder and embedding a heater coil, made of ferrochrome, nickel, etc., in the powder. In addition to this, a ceramic heater type is also known, as disclosed in Japanese patent laid-open No. 41523/1982, which comprises a heating wire, made of tungsten, etc., is embedded in an insulating ceramic material, such as silicon nitride. The ceramic heater type has been widely used in recent years because it has a better heat transfer efficiency and an excellent heat build-up performance since it becomes red hot in a short period of time during heating, compared with the sheathed heater type which involves indirect heating by means of heat-resistant insulating powder and the sheath.

The glow plug of the ceramic heater type, however, has a metallic heating wire, made of tungsten, etc., embedded in the inside of an insulating ceramic material, such as silicon nitride. Because of different coefficients of thermal expansion of both the members, a sharp temperature rise during heating and the repeated use of the heater tend to deteriorate the reliability, including heat resistance, of the ceramic heater. This also results in increased manufacturing costs.

To solve this problem, a ceramic heater construction in which an electrically resistive ceramic material having a coefficient of thermal expansion substantially equal to that of an insulating ceramic material is used as a heating wire has been proposed in Japanese patent laid-open Nos. 9085/1985 and 14784/1985. Both the proposed glow plugs have problems in terms of construction and function, and have not been put into commercial application.

The former, for example, having a construction in which an electrically resistive ceramic material as a heating element is embedded in an insulating ceramic material, exhibits a better heat transfer efficiency than the sheathed heater type. But it has a poor quick-heating function because it is based on indirect heating and involves complex forming and machining. The latter, on the other hand, has a good quick-heating function because its heating element is exposed on the heater surface. The construction of its heating element in which U-shaped members are laminated, with both ends thereof being led to the rear end of the heater, makes the electrode takeoff method extremely complicated, resulting in high manufacturing costs.

In this type of glow plug, there is an increasing market demand in recent years for improved starting performance of the diesel engine, improved durability to withstand the high-temperature service conditions associated with the adoption of turbo-chargers, and the increased use of the after-glowing system in which the glow plug is kept energized for a predetermined period of time after the engine has been started to ensure smooth and adequate combustion inside the engine as exhaust and noise control means. In addition, there is an increasing demand for extending the after-glowing time as long as possible (to approximately ten minutes, for example). That is, even after the diesel engine has been started, it takes much time to warm up the engine in a cold region, for example, because it is chilled down to too low a temperature. In such a non-warmed-up state, engine noise is uncomfortably large during idling. Moreover, the resulting incomplete combustion often causes white smoke, and leading to an engine shutdown in extreme cases. To prevent these troubles, the aforementioned after-glowing and other measures are needed. To achieve longer after-glowing time, it is necessary to substantially improve the heating properties of a heating element while preventing overheating by controlling the power applied to the heating element and to furnish the heater with a self temperature saturation function so as to keep the saturation temperature of the heater below an appropriate temperature limit. Taking these points into account, the development of an inexpensive glow plug which has a quick-heating function and self temperature saturation properties and is excellent in reliability, including heat resistance.

SUMMARY OF THE INVENTION

It is the first object of this invention to provide a glow plug for diesel engines that can accomplish quicker and more positive red heating at the tip than the conventional type of glow plug, and act as a quick-heating type.

It is the second object of this invention to provide a glow plug for diesel angines that does not cause cracks and other defects even at a sharp temperature rise during the heating of a ceramic heater, and can maintain reliability, including heat resistance.

It is the third object of this invention to provide a glow plug for diesel engines that can accomplish after glowing for a long time as an exhause and noise control means for the engine in which the glow plug is installed.

it is the fourth object of this invention to provide a glow plug for diesel engines that has a simple construction and is easy to manufacture.

DETAILED DESCRIPTION OF THE EMBODIMENTS

Figure 1:
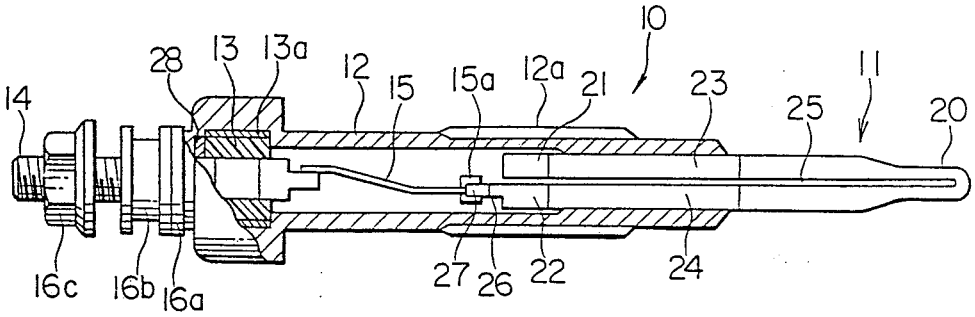
FIG. 1 is a longitudinal section showing a first embodiment of this invention.

FIG. 1 is a longitudinal section showing a first embodiment of this invention.

The construction of a glow plug which is referred to as numeral 10 in the figure will be outlined in the following. The glow plug 10 has a rod-shaped ceramic heater 11, the tip of which serves as a heating element, and a substantially tubular metallic holder 12, which holds the ceramic heater 11 at the tip thereof. At the rear end of the holder 12, an external connection terminal 14 is fitted concentrically via an insulating bush 13, made of a synthetic resin. The external connection terminal 14 is connected to a lead 22 of the ceramic heater 11 via a metallic lead wire 15, such as a flexible wire, and a terminal cap 15*a*. Numeral 13*a* is a metallic pipe, which is integrally fitted to the outer circumferential part of the insulating bush 13, and crimped at the rear end of the holder 12 so as to fit the insulating washer 13 integrally to the side of the holder 12 at a predetermined strength, thereby eliminating the effects of temperature. 16*a*, 16*b* and 16*c* are an insulating ring screwed onto the threaded part of the rear end of the external connection terminal 14, a fixing nut, and a nut for fastening an external lead wire, respectively. The external connection terminal 14 is electrically connected to a battery terminal (not shown) by holding a lead wire from the battery between the nuts 16*b* and 16*c*. By screwing the threaded part 12*a* onto the outer circumferential part of the holder 12 to a threaded hole (not shown) provided on the cylinder head of the engine, the ceramic heater 10 is grounded and the tip thereof is disposed protruding in an auxiliary combustion chamber or a combustion chamber of the engine. The ceramic heater 11 is connected to the external connection terminal 14 via the metallic lead wire 15 so that the ceramic heater 11 is protected from vibrations, fastening torque and various other mechanical forces exerted to the external connection terminal 14. The metallic lead wire 15 is recommended to be made of any flexible wire.

Figure 2:
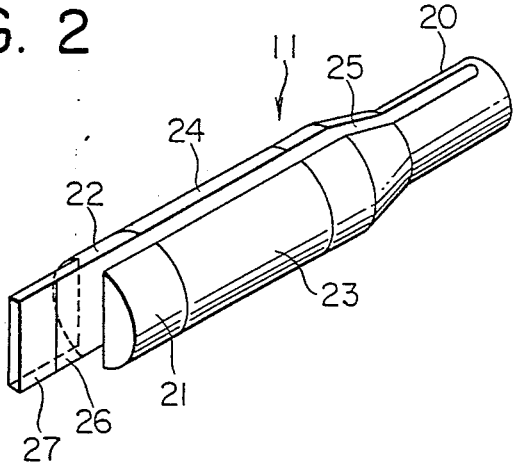
FIG. 2 is an enlarged perspective view of the ceramic heater shown in FIG. 1.
Figure 3:
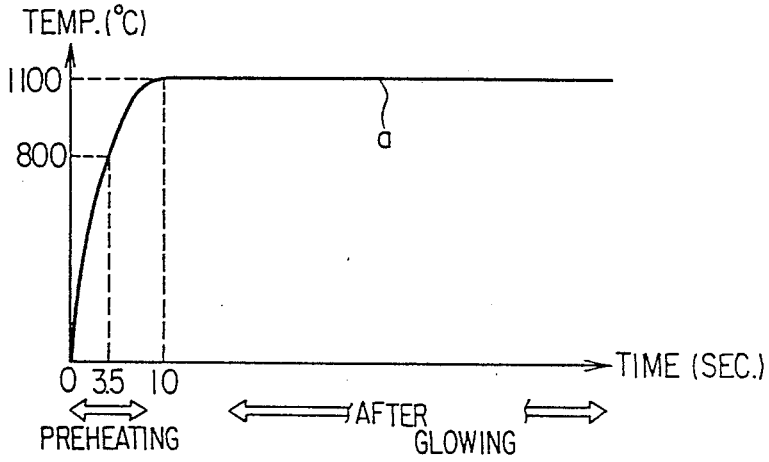
FIG. 3 is a diagram showing the temperature characteristics of a ceramic heater.

FIG. 2 is an enlarged perspective view of the ceramic heater 11. Like parts are indicated by the same numerals as in FIG. 1. In FIG. 2, a heating portion 20 is formed in a smaller diameter so that the thickness of the heating portion 20 is smaller than the thickness of the leads 21 and 22. A slit 25 is formed at the middle part of the ceramic heater 11 from the heating portion 20 towards the leads 21 and 22. A matallized layer 23 is formed on the outer circumferential surface of a lead 21 out of the leads 21 and 22 which are formed of an electrically resistive ceramic material integrally with the heating portion 20, while an insulating coating layer 24 is formed on the other lead 22. Nickel-plated layers (not shown) are provided on the surfaces of the matallized layer 23 and the insulating coating layer 24. The ceramic heater 11 is joined and fixedly fitted to the tip of the holder 12, as shown in FIG. 1, via the metallized and insulating coating layers 23 and 24 and the nickel-plated layers thereon, using an appropriate means, such as silver brazing. A nickel-plated layer can also be provided on the joint surface of the holder 12 as occasion demands.

The aforementioned ceramic heater 11 can be manufactured by mixing electrically resistive sialon powder with a thermoplastic resin and injection-molding the mixture into a predetermined metal mold, and sintering the molding, or forming a rod-shaped ceramic heater preform into a predetermined shape with electrical spark forming or ordinary machining. After these forming operations, a metallized layer 23 and an insulating coating layer 24 (by flame spraying alumina, etc.) are formed on the corresponding outer circumferential surfaces of the leads 21 and 22, and then nickel-plated layers are formed on the surfaces of the layers 23 and 24 as auxiliary materials for joining the layers 23 and 24 with the metallic holder 12 shown in FIG. 1. Numeral 27 in FIG. 2 is a metallized layer formed on an electrode end 26, on which a nickel-plated layer is formed. A heater assembly is formed by connecting the metallic lead wire 15 to the metallized layer 27 via the terminal cap 15*a*. The ceramic heater 11 formed in the manner described above is fitted into the holder 12, and the outer circumferential surfaces of the leads 21 and 22 are fixedly fitted to the inside of the holder 12 via the metallized layer 23 and the insulating coating layer 24 with an appropriate joining means such as silver brazing. The assembly of the glow plug 10 is then completed by connecting the rear end of the metallic lead wire 15 to the external connection terminal 14 supported by the rear end of the holder 12.

Since the thickness and other dimensions of each part of the abovementioned ceramic heater 11 can be adjusted freely at the time of forming, the resistance value of the heater 11 can be selected freely by adjusting the thickness of the heater 11. In this embodiment, for example, the ceramic heater 11 is formed in such dimensions that the diameter of the heater body is 5 mm and that of the heating portion 20 3 mm, and the overall length of the heater (excluding 5 mm of the length of the electrode end 26) is 50 mm, with the length of the heating portion 20 being 10 mm. The metallized layer 23 and the insulating coating layer 24 are formed over a length of 20 mm from the location 25 mm away from the tip thereof. It was confirmed in various experiments that this construction permits the heating portion 20 to have a thermal capacity lower than that of the leads 21 and 22 and to have a predetermined resistance value, thereby exhibiting the required self temperature saturation properties. Furthermore, when the ceramic heater 11 is used in an environment requiring severe working conditions, though description was not made in the abovementioned embodiment, better durability can be achieved by applying a protective film having anti-oxidation properties to the outer surface of the ceramic heater 11 with deposition or any other appropriate means.

In an experiment on a glow plug 10 incorporating the ceramic heater 11, it was confirmed that the temperature of the heater reaches 800° C. in 3.5 sec. and rises to approximately 1,100° C. with the saturation temperature being kept below the allowable limit of 1,200° C.

With the glow plug 10 of the abovementioned construction, as shown in FIGS. 1 and 2, the presence of a slit 25 formed along the length of the ceramic heater 11 causes the space inside the holder 12 to be opened into the engine combustion chamber to which the ceramic heater 11 is fitted. Consequently, it is necessary to prevent the high-pressure combustion gas evolved during combustion in the combustion chamber from leaking to the outside of the engine. To this end, this embodiment adopts a mechanical seal construction in which a sealing sheet 28, made of asbestos, rubber, etc., is placed at the outside end of an insulating bush 13 provided integrally with the external connection terminal 14 at the rear open end of the holder 12, as shown in FIG. 1. Needless to say, there can be a number of variations in the location and method of sealing. For example, an O ring may be disposed at the inside end of the insulating bush 13 to seal the holder 12.

Figure 4:
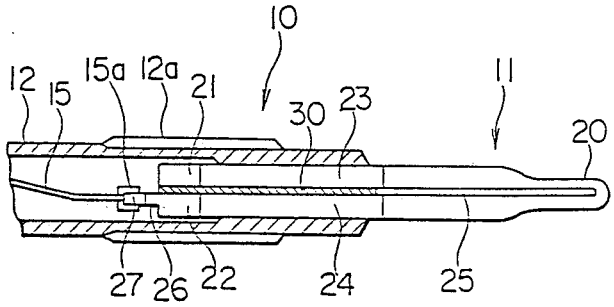
FIG. 4 is a longitudinal section of the essential part of a second embodiment of this invention.

FIG. 4 is the longitudinal section of the essential parts of a second embodiment of this invention. Like parts are indicated by the same numerals as in FIGS. 1 and 2. In FIG. 4, numeral 30 refers to an insulating sheet, made of an insulating ceramic material, which is inserted between the leads 21 and 22 of the ceramic heater 12 and integrally joined therewith at a portion corresponding to at least the tip portion of the holder 12. With this construction, the slit 25 is closed and sealed at the portion of the holder 12 to prevent engine combustion gas from leaking to the outside of the engine. With the abovementioned construction, the mechanical strength of the ceramic heater 11 at the rear end thereof supported by the holder 12 can be improved. At the same time, the sealing sheet 28 as in the abovementioned embodiment can be eliminated.

For the insulating ceramic material mentioned above, sialon can be used, as in the case of the electrically resistive ceramic material used to form the ceramic heater 11. By selecting such a material, the insulating sheet 30 can be made of the same material having a coefficient of thermal expansion substantially equal to that of the material of the resistor, and the joint strength thereof can be increased to maintain reliability, including heat resistance. Members made of the abovementioned insulating and electrically resistive sialon-based ceramic materials can be firmly joined together by sintering the members in the presence of $Y_2O_3$ or any other oxide as a sintering assistant in a state where a diffusion layer is formed on the joint portion. Needless to say, any other commonly used method of joining ceramic materials, such as the halide method, brazing method, or solid-phase joining method, may be used. Moreover, a material chiefly consisting of SiC, $Si_3N_4$, AlN or $Al_2O_3$, which has excellent heat resistance and good joint strength when joining with electrically resistive ceramic materials, or an insulating material, such as glass, may be used as an insulating ceramic material for manufacturing the insulating sheet 30. Since the insulating sheet 30 is located at the rear end of the ceramic heater 11. far away from the heating portion 20, no practical problems need arise even when the reliability of the joint portion is deteriorated slightly.

Figure 5:
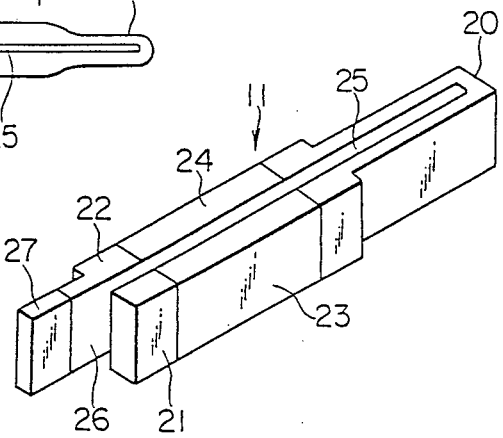
FIG. 5 is an enlarged perspective view of a ceramic heater, which is a third embodiment of this invention.
Figure 6A:
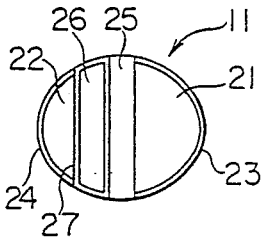
FIGS. 6A and 6B are side elevations of ceramic heaters which are fourth and fifth embodiments of this invention, respectively, viewed from the lead side.
Figure 6B:
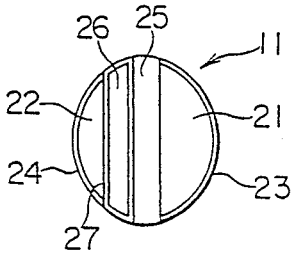

This invention is not limited to the constructions of the abovementioned embodiments, but the shape, construction, etc. of each portion may be changed and modified in an appropriate manner. The shape of the ceramic heater 11, for example, is not limited to the round bar shape described in the abovementioned embodiments, but it is obvious that the shape of the heater 11 may be a square rod shape having a rectangular cross section, as shown in FIG. 5, or an elliptical rod shape, as shown in FIGS. 6A and 6B.

Figure 7:
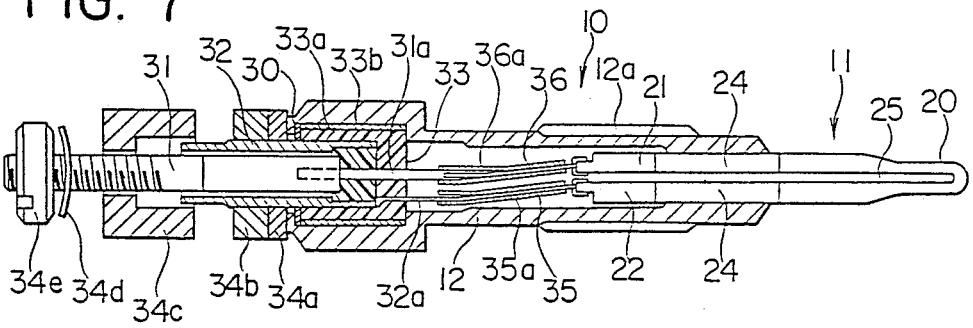
FIG. 7 is a longitudinal section showing a sixth embodiment of this invention.

In the abovementioned embodiments, moreover, a metallized layer 23 is formed on one lead 21 and an insulating coating layer 23 on the other lead 22 as electrically conductive and insulating layers, respectively, and joined with the inside of the holder 12 by brazing in order to fixedly fit the ceramic heater 11 to the holder 12 in a state where the ceramic heater 11 is cantilevered at the tip of the holder 12. This invention is not limited to this construction. For example, an insulating layer made of glass or any other insulating material may be formed on each of the outside surfaces of the leads 21 and 22 of the ceramic heater 11 and a metallic lead wire may be fixed to each of the layers. FIG. 7 is a longitudinal section of an embodiment having such a construction. Like parts are indicated by the same numerals as in FIGS. 1, 2 and 4 through 6. In the figure, a terminal assembly 33 having first and second external connection terminals 31 and 32 passed through and embedded in an insulating material, such as a synthetic resin, is fitted and supported at the rear end of the holder 12, with the terminals 31 and 32 being connected to the leads 21 and 22 comprising the abovementioned ceramic heater 11 via metallic lead wires 35 and 36 having the same construction as above. The terminal assembly 33 has a first external connection terminal 31 having on the inside end thereof a rod portion **31*a* disposed on the axial line of the assembly 33 and connected to the lead wire 36, and a second external connection terminal 32 of a cylindrical shape disposed at a predetermined gap around the first external connection terminal 31 and having a lead lug 32*a* extended from part of the inside end thereof for connection to the lead wire 35, and an assembly body 33*a* made of a resin for insulating the terminals 31 and 32 and putting the terminals 31 and 32 together into one piece, with an insulating layer provided along the outer periphery thereof. A metallic tube 33*b* for reinforcing connection is provided on the outer periphery of the assembly body 33*a*. The metallic tube 33*b* is crimped with a high pressing force at the peripheral part of the open rear end of the holder 12. As a result, the inside of the metallic tube 33*b* is forced toward the assembly body 33*a*, made of a resin, and the outside thereof toward the inner wall of the holder 12** to eliminate the adverse effects of external forces and thermal shrinkage.

In the figure, numerals **34*a* and 34*b* refer to an insulating ring and a washer; 34*c* to an insulating material fitted to the first terminal 31 at the outside end of the washer 34*b*; and 34*d* and 34*e* to a spring washer and a fastening nut screwed onto the threaded part formed on the outside end of the first terminal 31, respectively. The terminals 31 and 32 are electrically connected to the battery terminals by fastening a lead wire (not shown) and a negative-side lead wire (not shown) from the battery between the washer 34*b* and the insulating member 34*c*, and between the insulating member 34*c* and the spring washer 34*d*. 35*a* and 36*a* in the figure are insulators provided on the metallic lead wires 35 and 36. An insulating coating layer 24 is provided on the outside surface of the leads 21 and 22 and supported by the tip of the holder 12, while the rear ends of the leads 21 and 22 are connected to the first and second external connection terminals 31 and 32 supported in an insulated state by the rear end of the holder 12 via the metallic lead wires 35 and 36**. The construction of the ceramic heater is the same as that of the abovementioned embodiments, except the portion described above. The operation of the ceramic heater is therefore the same as that of the preceding embodiments.

Next, the material used in manufacturing the ceramic heater of this invention will be described.

When a $\beta$-type sialon is used as the material for the ceramic heater, it is desirable to use a $\beta$-type sialon of such a composition that the z value in $Si_{6-z}Al_zO_zN_{8-z}$ is more than 0 and less than 1 because a composition within this range yields a sintered product having a great strength.

When an $\alpha/\beta$-type sialon is used, it is desirable to use an $\alpha/\beta$-type sialon having a composition expressed as $M_x(SiAl)_{12}(ON)_{16}$ where M consists of Y or Ca and x is more than 0 and less than 2.0 because a composition within this range yields a sintered product having a great strength. It should be noted that the whole or part of Y or Ca can be replaced with Mg.

More specifically, when an $\alpha/\beta$-type composite sialon phase of $Y_x(SiAl)_{12}(ON)_{16}$ is used, the mol ratio of $Si_3N_4$ to ($Si_3N_4+Y_2O_3+AlN$) is usually set at 50–70%. With a mol ratio less than 50%, the grain boundary phase produced by $Y_2O_3+AlN$ is increased, deteriorating heat resistance and strength, making it inconvenient for use as the heater because the function of the sialon phase cannot be maintained. As the mol ratio exceeds 70%, on the other hand, the $\beta$ sialon becomes predominant, making it difficult to maintain the $\alpha$ sialon. This deteriorates sintering properties too low a level to produce a dense sintered product by low-temperature sintering.

Furthermore, it is desirable to set the mol ratio of $Y_2O_3/AlN$ at a theoretical value, that is, not less than 1/9 and less than 7/3. The mol ratio is set at not less than 1/9 in the above description because the absence of an excess amount of $Y_2O_3$ would cause the shortage of $Y_2O_3$ to be consumed in the grain boundary, leading to the remarkable deterioration of sintering properties, while the above-mentioned ratio is set at less than 7/3 because a ratio exceeding 7/3 would sharply reduce the $\alpha$ sialon phase to less than 20%, making it difficult to maintain the heat resistance and toughness of a complex sialon.

In the $\alpha/\beta$ complex sialon phase of $Ca_x(SiAl)_{12}(ON)_{16}$, the mol ratio of $Si_3N_4$ to ($Si_3N_4+CaO+AlN$) is limited to 50–80%, and the mol ratio of CaO/AlN is limited to 2/8–8/2 for the same reasons described above in relation to $Y_x(SiAl)_{12}(ON)_{16}$.

In the abovementioned compositions, AlN can be replaced with AlN solid-solution powders equivalent to AlN.

Next, description will be made about the electric conductivity donor material.

In this invention a nitride or carbo-nitride solid-solution of Ti is added as an electrically conductive compound for the following reasons.

Although the use of any of carbides, nitrides or borides of the IVa, Va, or VIa column can of course produce an electrically resistive sintered sialon, the choice is rather limited to carbides and nitrides of Ti when considering sintering properties in cold or gass-pressure sintering and the anti-oxidation properties of sintered products. Furthermore, the use of a carbo-nitride solid-solution, instead of a carbide or nitride alone, could yield the benefit of obtaining sialon sinters having varied electric resistivity by changing the ratios of C and N in the solid-solution.

The abovementioned nitride or carbo-nitride solid-solution of Ti is added in an amount more than 20 vol.% and less than 70 vol.% for the following reasons. An amount of addition not more than 20 vol.% would not produce appropriate conductive paths by the contact of the grains of the nitride or carbo-nitride solid-solution, leading to poor conductivity, whereas a sintered product of a Ti content exceeding 20 vol.% would exhibit electric conductivity based on the positive resistance-temperature characteristics, in which electric resistivity continuously changes with increases in Ti content. With a Ti content not less than 70 vol.%, the anti-oxidation properties and high-temperature strength of sialon are remarkably deteriorated. Consequently, the amount of Ti addition should preferably be more than 22 vol.% and less than 50 vol.%.

The addition of a nitride or carbo-nitride solid solution of Ti will be described in more detail.

The table below shows the measurement results of density, cold strength and strength at 1,000° C. of sintered products with changes in TiN addition to a $\beta$-type sialon ($Si_3N_4$—7 wt.% $Y_2O_3$—5 wt.% $Al_2O_3$—3 wt.% AlN). The strength values in the table were measured with the 3-point bending method, with a span of 30 mm, and a cross-head speed of 0.5 mm/min.

| No. | TiN addition (vol. %) | Density (%) | Strength at room temperature (kg/mm) | Strength at 1,000° C. (kg/mm) |
|---|---|---|---|---|
| 1 | 20 | 99.2 | 85 | 82 |
| 2 | 30 | 99.1 | 84 | 80 |
| 3 | 40 | 99.3 | 86 | 80 |
| 4 | 50 | 98.9 | 80 | 77 |
| 5 | 60 | 98.8 | 75 | 70 |
| 6 | 70 | 96.5 | 51 | 42 |
| 7 | 80 | 95.0 | 32 | 25 |

As is evident from the table above, density tends to lower with increases in TiN addition, particularly when the amount of TiN addition exceeds 70 vol.%, at room temperature and strength at 1,000° C. sharply decrease. This tendency is similarly found when a carbo-nitride solid-solution is added. It is for this reason that the addition of a nitride or carbo-nitride solid-solution of Ti is limited to the range mentioned above.

Figure 8:
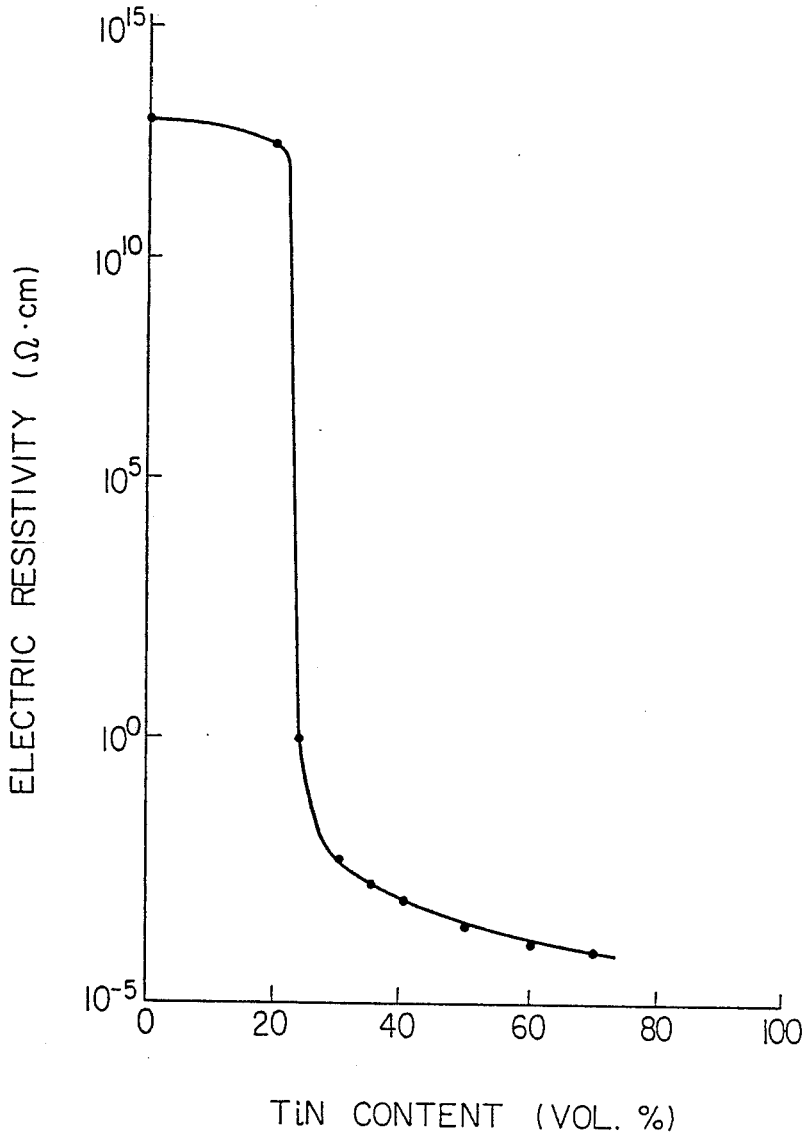
FIG. 8 is a diagram illustrating the relationship between Ti addition and electric resistivity.

Next, FIG. 8 shows the measurement results of changes in electric resistivity when TiN is added to the $\beta$-type sialon mentioned above. As can be seen in the figure, with a TiN content less than 20%, electric resistivity increases to a large degree, making the sintered product unsuitable as an electrically conductive material. The figure reveals that electric resistivity values remain relatively stable in a range below $10^0$ ohm-cm, or 1 ohm-cm.

Addition of TiCN, in place of TiN, tends to shift electric resistivity to slightly larger values in the figure above. As in the case of TiN, resistivity values remain relatively stable in a range below 1 ohm-cm.

The abovementioned $\alpha/\beta$-type sialon chiefly comprises the following four phases; a Y or Ca-bearing $\alpha$ sialon expressed as $M_x(SiAl)_{12}(ON)_{16}$ and a $\beta$ sialon expressed as $Si_{6-z}Al_zO_zN_{8-z}$ as the main phases of the $\alpha/\beta$-type complex sialon; an amorphous or crystalline substance containing Y, Si, O, N and Al, or Ca, Si, O, N and Al as the grain boundary phase thereof; and TiN grains as an additive. It is also possible to crystallize the grain phase by heat treatment, or cooling rate control ducting sintering.

Having the abovementioned construction, the glow plug for diesel engines of this invention has the following beneficial effects.

(1) Though having a simple construction, the glow plug having a heating portion exposed on the outside surface of the heater can red heat the tip thereof more rapidly and positively than the conventional type, and can give full play to the quick-heating function thereof.

(2) Since the coefficients of thermal expansion of resistor and insulating materials comprising the heating and lead portions are made substantially equal, the joint strength of the resistor and insulating materials is increased, and cracks and other defects are not caused even at a sharp temperature rise during heating by the heater. This leads to improved reliability in heat resistance.

(3) Because of a small thermal capacity of the tip of the heating portion, the heater has self temperature saturation properties, enabling after glowing for a long time as exhaust and noise control measures for the diesel engine.

(4) Having a simple overall construction, the forming, machining and assembly of the glow plug is easy, leading to improved productivity.

What is claimed is:

1. A glow plug for diesel engines characterized in that a ceramic heater comprising a U-shaped heating portion and a pair of leads formed integrally with said U-shaped heating portion and extending backwards from both ends of said U-shaped heating portion is supported at the tip of a hollow holder in a cantilevered state where one end of said heater is protruded outwards; at least the outside surface of one of said leads being joined and held by the inside of said holder via an insulating layer; and at least the rear end of the other of said leads being connected to an external connection terminal, which is supported in an insulated state by the rear end of said holder, via a metallic lead wire; said ceramic heater is formed integrally by an electrically resistive sintered sialon, which is formed by adding 20–70% vol.% Ti nitride or carbide-nitride as an electric conductivity donor to a $\beta$-type sialon or $\alpha/\beta$-type sialon.

2. A glow plug for diesel engines as claimed in claim 1 wherein the thickness of said U-shaped heating portion comprising said ceramic heater is made smaller than the thickness of said leads.

3. A glow plug for diesel engines as claimed in claims 1 or 2 wherein the electric resistivity at the room temperature of said sintered sialon is less than 1 ohm-cm, with the resistance-temperature coefficient thereof being positive.

4. A glow plug for diesel engines as claimed in claim 1 wherein said $\beta$-type sialon is $Si_{6-z}Al_zN_{8-z}$ having such a composition that z is more than 0 and less than 1.

5. A glow plug for diesel engines as claimed in claim 1 wherein said $\alpha/\beta$-type sialon is $M_x(SiAl)_{12}(ON)_6$ having such a composition that M is Y or Ca, and x is more than 0 and less than 2.0.

6. A glow plug for diesel engines as claimed in claim 4 wherein the grain boundary layer of said electrically conductive sintered sialon is an amorphous substance containing Y, Si, O, N and Al.

7. A glow plug for diesel engines as claimed in claim 1 wherein said electric conductivity donor is TiN.

8. A glow plug for diesel engines as claimed in claim 1 wherein said electric conductivity donor is a carbonitride solid-solution of Ti.

9. A glow plug for diesel engines as claimed in claim 1 wherein an insulating sheet for sealing combustion pressure is integrally interposed between said pair of leads at a portion corresponding to the tip of said ceramic heater holder.

10. A glow plug for diesel engines as claimed in claim 1 wherein one of said leads is electrically connected to said holder via an electrically conductive layer, and the other of said leads is connected to said external connection terminal held by the rear end of said holder via a metallic lead wire.

11. A glow plug for diesel engines as claimed in claim 1 wherein each of the outside surfaces of said pair of leads is joined and held by the inside of said holder via an insulating layer, and each of said leads is connected to each of external connection terminals via a metallic lead wire.

* * * * *